United States Patent [19]

Hutchins

[11] 4,145,847

[45] Mar. 27, 1979

[54] STRAIGHT LINE ABRADING TOOL WITH BALANCING COUNTERWEIGHT

[75] Inventor: Alma A. Hutchins, Pasadena, Calif.

[73] Assignee: Hutchins Manufacturing Co., Pasadena, Calif.

[21] Appl. No.: 869,373

[22] Filed: Jan. 13, 1978

[51] Int. Cl.[2] ..... B24B 23/00

[52] U.S. Cl. ..... 51/170 TL

[58] Field of Search ..... 51/170 TL, 170 R, 175, 51/273, 268; 173/59, 170, 169

[56] References Cited

U.S. PATENT DOCUMENTS

| | | | |
|---|---|---|---|
| 3,793,781 | 2/1974 | Hutchins | 51/170 TL |
| 3,932,963 | 1/1976 | Hutchins | 51/170 TL |
| 4,052,824 | 10/1977 | Hutchins | 51/170 TL |
| 4,073,349 | 2/1978 | Sumida | 51/170 TL |

*Primary Examiner*—Harold D. Whitehead
*Assistant Examiner*—Roscoe V. Parker, Jr.
*Attorney, Agent, or Firm*—William P. Green

[57] ABSTRACT

A portable abrading tool having a shoe mounted for straight line reciprocating movement relative to a body, and driven by a reciprocating piston in the body through two spaced gear units, with a counterweight being driven by those gear units to reciprocate essentially with the piston and oppositely from the shoe, and with the counterweight desirably having two enlarged end portions and an intermediate reduced width portion carrying oppositely facing toothed racks engaging the two gear units respectively. The counterweight is desirably confined vertically between the body of the tool and the reciprocating shoe, and is slidably located within recesses in the under surface of the body.

21 Claims, 13 Drawing Figures

STRAIGHT LINE ABRADING TOOL WITH BALANCING COUNTERWEIGHT

BACKGROUND OF THE INVENTION

This invention relates to portable powered sanders or other similar abrading tools in which an abrading shoe is driven for straight line reciprocating movement relative to a carrying body.

In my U.S. Pat. No. 3,932,963, I have shown a straight line abrading tool in which the reciprocating shoe of the device is driven by a piston structure through a pair of gear units, in a manner effectively balancing out lateral forces exerted by the gear drive assembly. The piston structure desirably is of a type having two piston heads at opposite ends thereof, with the gear units preferably engaging toothed racks formed on opposite sides of the piston structure at a location between the two piston heads. Lower portions of the gear units in the device of that prior patent engage two racks formed on the shoe to reciprocate the shoe oppositely from the piston.

SUMMARY OF THE INVENTION

The present invention provides improvements on straight line sanders of the above discussed general type, and particularly is directed to the provision of a unique counterweight mechanism for further balancing the axial forces exerted by the different reciprocating masses to minimize any tendency for axial displacement of the body of the tool by any of those forces. The counterweight of the present invention is driven to reciprocate essentially in unison with the power piston structure, but oppositely from the shoe, so that the piston and counterweight together tend to balance the mass of the shoe. Certain particular features of the invention reside in a unique structural inter-relationship between the counterweight and the other moving parts of the device enabling reception of the various parts in a most compact overall package while effectively attaining the desired counterbalancing action.

Further, the drive mechanism for the counterweight is designed to avoid transmission to that weight of unbalanced forces tending to displace the weight transversely of the main axis of longitudinal reciprocation of the tool, or tending to swing the weight about any other axis, so that the forces exerted against the counterweight act only to cause its desired longitudinal reciprocation and do not produce excessive wear of any type on the counterweight or any of its guiding parts.

The counterweight is preferably confined vertically between the body of the tool and the lower reciprocating abrading shoe, and for best results is received and guided within a recess or recesses in the underside of the body. Two such recesses may be provided at longitudinally spaced locations in the underside of the body, to receive and guide two front and rear enlarged portions of the counterweight.

The counterweight is preferably driven for its axial reciprocating movement by two spaced gear units similar to those employed in my above-mentioned prior patent no. 3,932,963. The counterweight has two toothed rack portions facing in opposite directions transversely of the axis of reciprocating movement of the shoe and piston, and engaging the two gear units respectively in a manner causing the lateral or transverse forces exerted by one of the units against the counterweight to be resisted or counterbalanced by opposing forces exerted by the other gear unit, with the result that the overall force exerted against the counterweight in a transverse direction is nil. The counterweight may have a reduced width portion intermediate the two previously mentioned enlarged front and rear end portions and carrying the two racks between and in engagement with teeth formed in the lower portions of the two gear units.

BRIEF DESCRIPTION OF THE DRAWINGS

The above and other features and objects of the invention will be better understood from the following detailed description of the typical embodiments illustrated in the accompanying drawings, in which.

DESCRIPTION OF THE PREFERRED EMBODIMENTS

Figure 1:
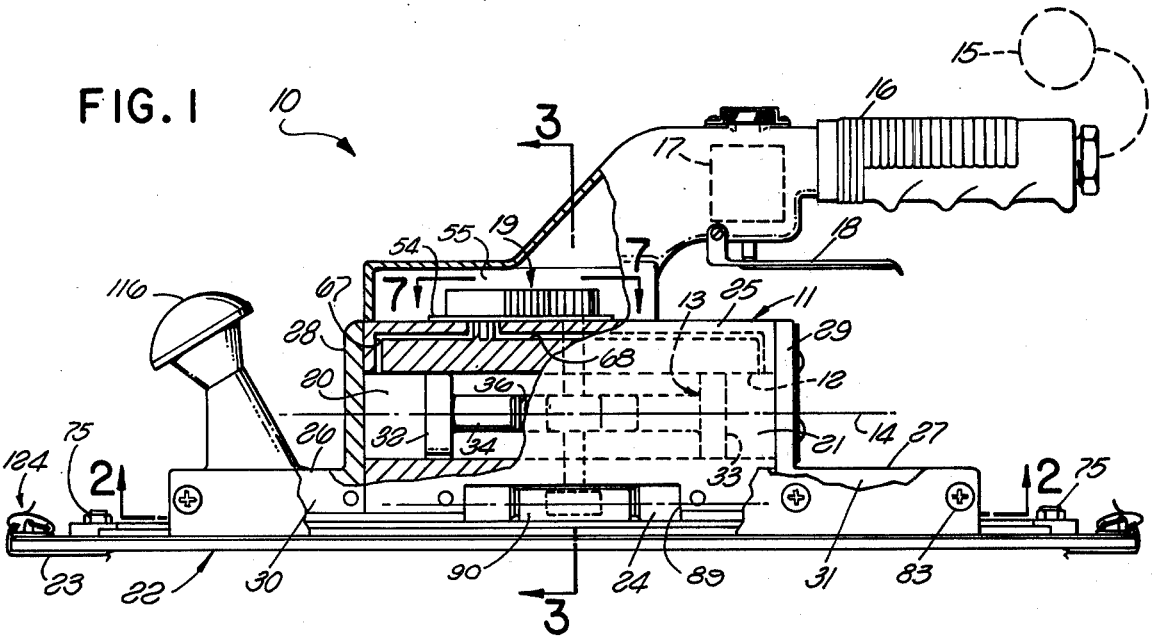
FIG. 1 is a side elevational view, partially broken away, of a portable powered sander constructed in accordance with the invention.

The portable powered sander 10 of FIG. 1 includes a main body 11 containing a cylindrical bore 12 within which a piston 13 is reciprocable along an axis 14. The compressed air or other actuating fluid is delivered to the opposite ends of cylinder bore 12 from a source 15 of such pressure fluid and through a tubular handle 16 rigidly secured to or forming a portion of body 11. A valve 17 controls the delivery of this compressed air to the reciprocating piston by actuation of a trigger element 18. An automatic valve assembly 19 admits the compressed air alternately to the cylinder chambers 20 and 21 at opposite ends of piston 13, at times to cause powered reciprocation of the piston. A shoe 22 extends along the underside of body 11, and is reciprocable in a straight line motion parallel to axis 14 to cause a sheet of sandpaper 23 at the underside of the shoe to abrade a work surface. This sandpaper sheet may be retained on the shoe by an appropriate adhesive, or by clips represented at 124. The present invention is particularly concerned with the provision in the device of a counterweight 24 which is located at the bottom of the body 11 and reciprocates with piston 13.

The body 11 is formed sectionally of a main central part 25 containing the cylindrical bore or passage 12, and two opposite end members 26 and 27 having upstanding end walls 28 and 29 which are secured to the opposite ends of part 25 to close bore 12. The lower portions of end members 26 and 27 project horizontally in opposite longitudinal directions at 30 and 31 along the upper side of shoe 22.

The piston 13 is of a double ended type, having two enlarged piston heads 32 and 33 at its opposite ends joined by a reduced diameter portion 34 of the piston having two series of rack teeth 35 and 36 extending along its opposite sides and facing in opposite horizontal directions transversely of the axis 14 of piston reciprocation. At opposite sides of these rack structures formed on portion 34 of the piston, the body 11 carries two gear units 37 and 38, which are mounted to turn about two parallel vertical axes 39 and 40 (FIG. 3) lying in a common vertical plane disposed transversely of axis 14. The gear unit 38 includes a vertical shaft 41 rigidly carrying two vertically spaced gears 42 and 43, the first of which meshes with and is oscillated rotatively by the rack teeth 36 on piston 13. The second gear unit 37 has a similar vertical shaft 44 rigidly carrying two vertically spaced gears 45 and 46, the first of which engages the second set of rack teeth 35 on piston 13. Shafts 41 and 44 are appropriately journaled for rotation relative to the body 11, as by reception of their upper end portions within two top bushing elements 47 and 48, and by extension of their lower portions through a pair of roller bearings or other bearing assemblies 49 and 50. The bearings 49 and 50 may be thrust type bearings, acting to support shafts 41 and 44 against downward axial movement from the positions of FIG. 3.

Figure 3:
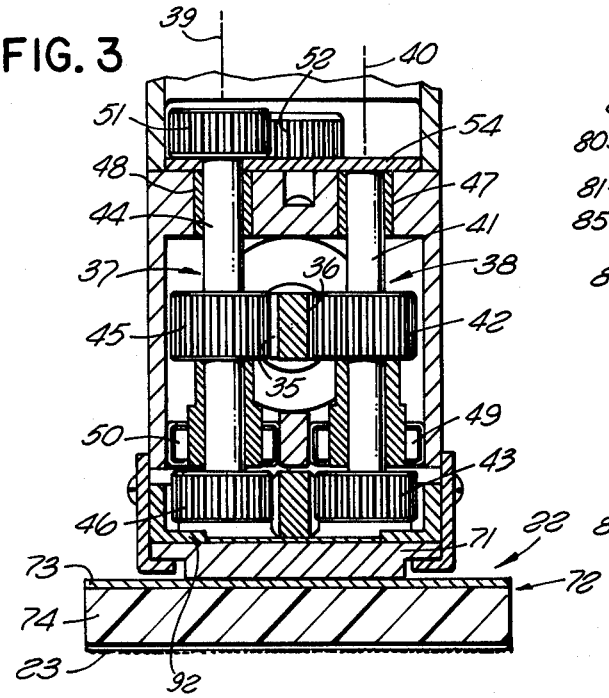
FIG. 3 is an enlarged vertical section taken on line 3—3 of FIG. 1.

The valve mechanism 19 may be driven by one of the two shafts 41 and 44, typically the latter as seen in FIG. 3. For this purpose, shaft 44 may rigidly carry at its upper end another gear 51, which meshes with an arcuate series of teeth 52 on a sector element 53 received adjacent an upper horizontal plate 54 on body part 25. As will be apparent from FIG. 1, the air from source 15 flows past valve 17 into an inlet chamber 55 formed at the top of body part 25 and between that part and the hollow handle member 16.

The valve mechanism 19 has been described in detail in my above-mentioned prior U.S. Pat. No. 3,932,963, and will not be described in as great detail in the present application. The sector part 53 of this valve mechanism is mounted to oscillate rotatively about a vertical axis 56 between different positions such as those shown in FIGS. 7–10, and in so moving this sector part 53 actuates a valve element 57 between different positions acting to admit pressure fluid to the piston as desired. As seen in FIGS. 6–10, the part 57 is shaped essentially as a sector of a circle, and is received within a similarly shaped recess 58 formed in part 53, but with the recess having a greater arcuate extent to allow a gap 59 between part 57 and the side or sides of the recess or opening 58, so that there is some lost motion between the oscillation of part 53 and part 57. The plate 54 secured to the upper surface of body part 25 carries a vertical post 61 to which part 53 is mounted for its rotary oscillation, and on which part 53 is retained by a spring clip 62. Plate 54 contains three radially elongated sector-shaped apertures 63, 64 and 65, the middle one of which communicates with an exhaust passage 66 in body 11 through which air may be discharged from the valve assembly to atmosphere. The other two apertures 63 and 65 communicate with passages 67 and 68 leading to chambers 20 and 21 at the opposite ends of the piston.

Figure 7:
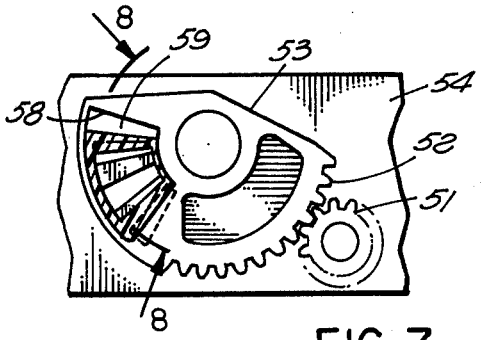
FIG. 7 is a fragmentary horizontal section taken on line 7—7 of FIG. 1, and showing the valve mechanism of the invention in one position of the parts.
Figure 9:
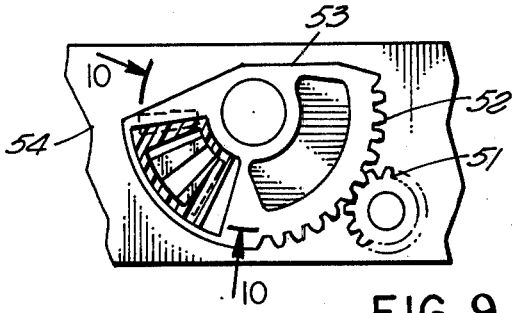
FIGS. 9 and 10 are views similar to FIGS. 7 and 8, but showing the valve mechanism in a second position.
Figure 8:
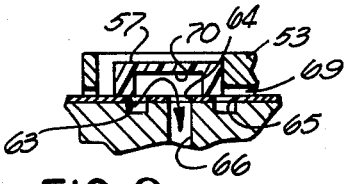
FIG. 8 is a vertical section taken on line 8—8 of FIG. 7.
Figure 10:
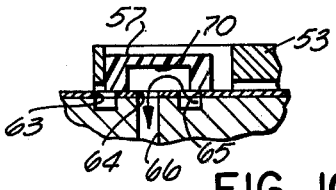

When the valve parts are in the positions represented in FIGS. 7 and 8, inlet air flows through a recess 69 at the underside of part 53 into aperture 65, and then through passage 68 to chamber 21 of FIG. 1, to cause leftward movement of the piston structure, while air exhausts from chamber 20 at the left end of the piston through passage 67, aperture 63, and passage 66. Such flow of the air between aperture 63 and passage 66 is permitted by forming part 57 to have a recess 70 at its underside of a width to provide communication between aperture 63 and passage 66. During this piston movement, the part 53 turns in a counterclockwise direction as viewed in FIG. 7, to ultimately bring the shoulder designated 58 in FIG. 7 into engagement with part 57, and then shift part 57 in a counterclockwise direction to the position illustrated in FIG. 9, in which air ultimately exhausts from the chamber to the right of the piston in FIG. 1, through apertures 65 and 64 and passage 66, and air is admitted to the left end of the piston through aperture 63 and passage 67. The motion of the piston is thus reversed, to move the sector element and valve in the opposite direction and back toward the position of FIGS. 7 and 8. In this way, reciprocation of the piston is attained.

The shoe assembly 22 includes a rigid main shoe part 71, having the vertical cross sectional configuration illustrated in FIG. 3, and to the underside of which there is mounted a pad assembly 72 consisting of a thin metal plate 73 having cushioning material 74 carried at its underside for cushioning the contact between sandpaper 23 and the work surface. Plate 72 is secured to the underside of shoe member 71 in any appropriate manner, as by means of screws 75 extending upwardly through the connected parts and carrying nuts at their upper ends. Part 71 has a horizontal planar upper surface 76 (FIGS. 3, 4 and 5), and a horizontal bottom surface 77 to which pad assembly 72 is secured, with the part 71 being cut away at its opposite sides to provide shallow recesses 78 into which two horizontally inwardly turned flanges 79 of two side plates 80 extend in a relation retaining part 71 slidably at the underside of body 11 of the tool. The side plates 80 have portions 81 extending upwardly adjacent vertical parallel side surfaces 82 of body part 25, and secured thereto by screws or other fasteners represented at 83 in FIG. 1.

Figure 11:
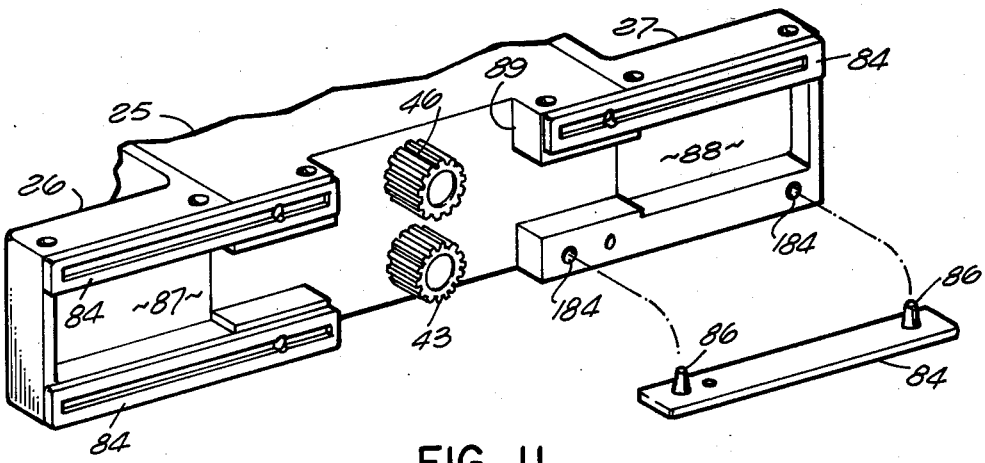
FIG. 11 is a perspective view of the underside of the body of the FIG. 1 tool.

At the upper side of shoe part 71, there are provided two pairs of bearing elements 84, which may be formed as thin strips of an appropriate low friction, low wear resinous plastic material, and which are confined vertically between the top surface 76 of part 71 and horizontal undersurfaces 85 formed on body part 25. Bearing parts 84 may be retained against horizontal movement relative to body part 25, as by extension of locating pins 86 on parts 84 upwardly into correspondingly shaped recesses 184 formed in body part 25 (FIG. 11). By virtue of the presence of bearing elements 84 between the body and shoe part 71, the shoe part can reciprocate freely relative to the body even though substantial force is exerted downwardly against the body by the user.

Figure 4:
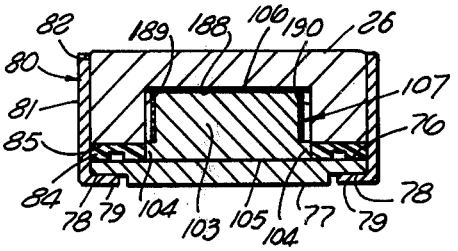
FIGS. 4 and 5 are fragmentary vertical sections taken on lines 4—4 and 5—5 respectively of FIG. 2.
Figure 5:
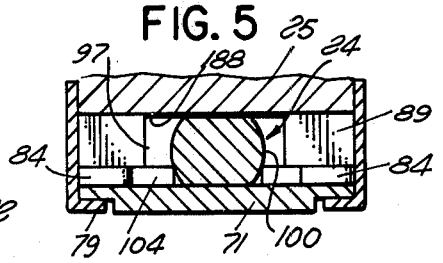

Laterally between the locations of each of the two pairs of bearing elements 84, there are provided two recesses 87 and 88, in the front and rear portions respectively of the tool body 11, and having the rectangular vertical sectional configuration illustrated in FIG. 4. More specifically, each of these recesses may be defined by an upper horizontal wall 88 and two opposite vertical sidewalls 189 and 190. The transverse sectional shape of these recesses is uniform along their entire front to rear length.

Figure 6:
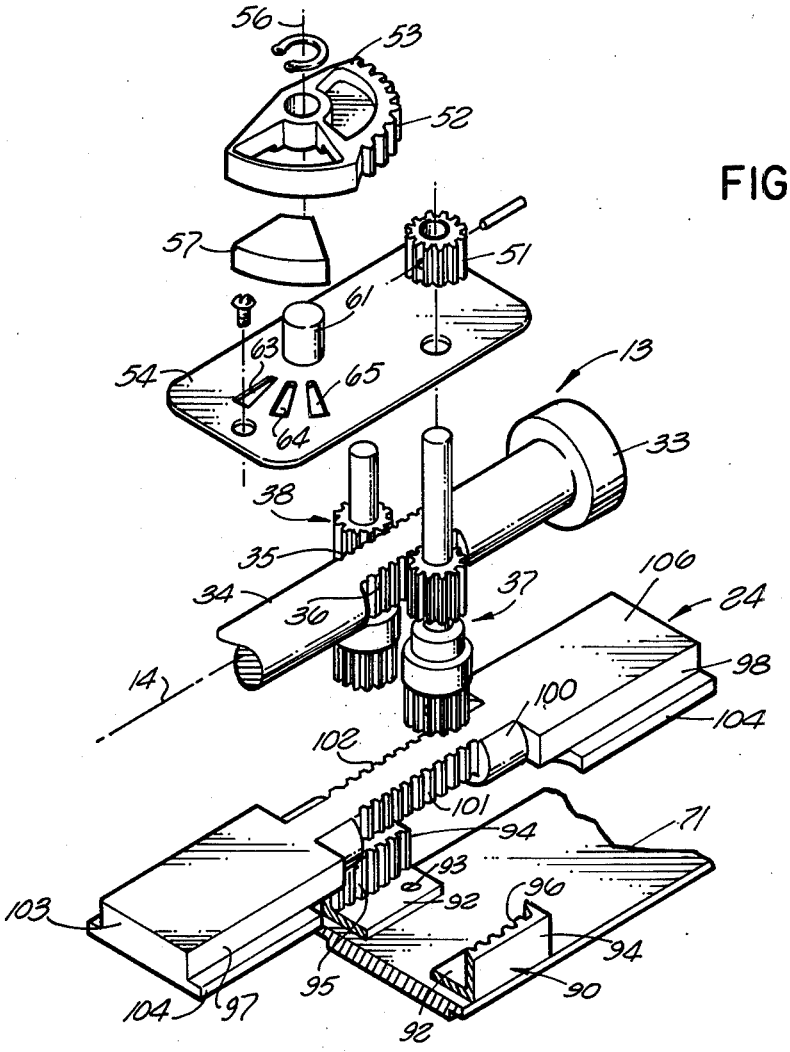
FIG. 6 is an exploded perspective view showing certain of the working parts of the tool.

Axially between the two recesses 87 and 88, the body is cut away at 89, to leave room for reception of the two gears 43 and 46 and two rack elements 90 and 91 which are carried by shoe part 71. As seen in FIGS. 3 and 6, these rack parts have horizontal flanges 92 which are secured by fasteners 93 to part 71, and have upwardly projecting portions 94 projecting upwardly at the locations of the opposite side edges of part 71 and at the outer sides of the two gears 43 and 46. These portions 94 carry or form two series of rack teeth 95 and 96, which face inwardly toward one another and transversely of the axis 14 of reciprocating movement of the parts, and which mesh with the teeth of gears 43 and 46 in a relation causing reciprocation of the shoe parallel to axis 14 but oppositely from the piston 13.

Counterweight 24 is confined vertically between the body 11 of the tool and shoe assembly 22. This counterweight has two similar opposite end portions 97 and 98 which are received and guided within body recesses 87 and 88 for only axial reciprocating movement along an axis 99 parallel to the main axis 14 of the piston. Between these end portions 97 and 98, the counterweight has a reduced width portion 100, which extends between the two gears 43 and 46, and which has toothed rack surfaces 101 and 102 at its opposite sides facing in opposite horizontal directions transversely of axes 14 and 99. These rack teeth 101 and 102 engage and mesh with the teeth of gears 43 and 46, to cause reciprocating movement of the counterweight 24 in correspondence with the rotary oscillating movement of the gear units, and parallel to axis 14. This reciprocating movement of the counterweight is in unison with the reciprocating movement of piston 13, that is, the counterweight always moves in the same direction as the piston. The movement of both of these parts, however, is the opposite of that of shoe assembly 22, so that when the shoe moves forwardly, the piston and counterweight move rearwardly, and vice versa. Thus, the mass of the counterweight is added to the mass of the piston in counterbalancing the weight of shoe 22.

Figure 2:
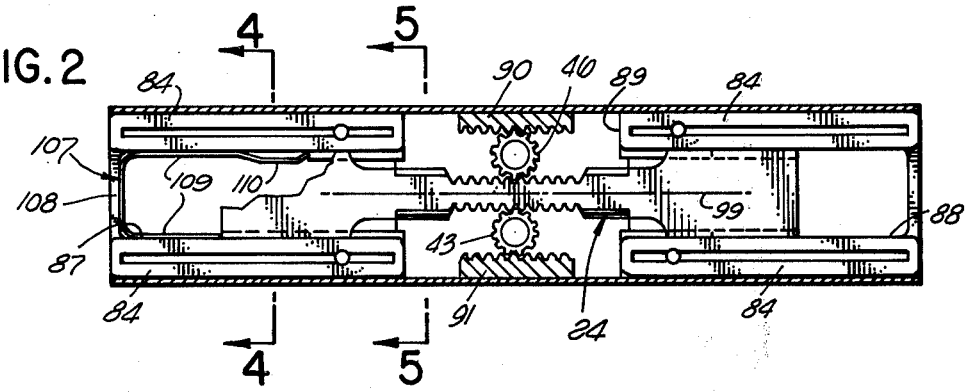
FIG. 2 is a horizontal section taken on line 2—2 of FIG. 1.

As seen in FIG. 4, each of the enlarged end portions 97 and 98 of the counterweight has an upwardly projecting main portion 103 which is a fairly close fit within and shaped essentially in correspondence with the vertical sectional configuration of the co-acting recess 87 or 88 in the body. At the bottom of that recess, each of the enlargements 97 and 98 has at its opposite sides two laterally projecting flanges 104, which slidably engage the two adjacent bearing elements 84, in a manner enabling those bearing elements to laterally retain engaged enlargement 97 or 98 and guide it for only the desired linear movement along axis 99. The slidably engaging surfaces of flanges 104 and bearing elements 84 contact along the entire front to rear extent of each of the enlargements. At its underside, each enlargement has a bottom horizontal surface 105 which is slidable along and located by the upper horizontal surface 76 of part 71. The top horizontal surface 106 of each enlargement 97 or 98 of the counterweight is received in close proximity to the top horizontal wall 188 of the corresponding body recess 87 or 88, to prevent substantial upward movement of the counterweight and thus coact with the other confining parts in locating the counterweight for only axial movement. Each of the enlargements may further be retained in position within the corresponding body recess by provision in each of those recesses of a leaf spring 107 (FIG. 2), having the essentially U-shaped horizontal sectional configuration illustrated in FIG. 2. More particularly, this leaf spring has a transverse crosspiece portion 108, and two similar axially extending essentially parallel arms 109 extending along opposite sides of the corresponding enlargement 97 or 98 and received between the side surfaces of that enlargement and the sidewalls 89 and 90 of the body recess. The extremities 110 of these spring arms may be bent inwardly as seen in FIG. 2, to exert yielding force inwardly against the sides of the enlargement and thus assist in locating the enlargement laterally in the recess.

In using the tool of FIGS. 1–11, an operator grasps the handle portion of element 16, and also grasps the forward handle 116, to position the tool on a work surface, following which actuation of trigger 18 commences reciprocation of piston 13. As the piston moves in one axial direction, it turns the two gear units 37 and 38 about their individual axes 39 and 40, to correspondingly drive the shoe 22 in an axial direction the opposite of that in which the piston moves, and drive the counterweight 24 in the same direction as the piston. The mass of the piston and counterweight may be approximately the same as the mass of the shoe 22, so that the effects obtained by movement of the various parts balance one another and tend to cause little or no movement of the cylinder body 11. When the piston reverses its direction of movement, the shoe and counterweight also reverse their direction, and the ultimate result is a minimum of vibration of the handle body combined with very effective sanding of the work piece.

Because the two gears 43 and 46 engage the racks 101 and 102 of the counterweight at opposite sides of the reduced portion of the counterweight, the tendency for engagement of one of the gears with its meshing rack teeth to urge the counterweight in one direction transversely of axis 14 is overcome by a corresponding opposed force exerted by the other gear acting against the oppositely facing rack teeth. There is thus no overall tendency to displace the counterweight 24 in either lateral direction. Further, since the two gears 43 and 46 turn exactly in unison, though oppositely, the force exerted by gear 43 in a forward or rearward direction at a particular instant corresponds exactly to the force exerted by the second gear 46 at the same instant in the same direction. The two gears and their engaged racks thus control very positively the reciprocating axial movement of the counterweight, and eliminate any tendency which might otherwise be present for swinging movement of the counterweight 24 about a vertical axis. As will be understood, if only one of the gears were present, besides urging the counterweight laterally as discussed above, that gear would also exert axial force only at one side of the counterweight and might, therefore, tend to swing the front enlargement of the counterweight in one lateral direction and the gear enlargement in the opposite lateral direction, or cause other unwanted movements of the counterweight which then would not be as effectively controlled as in the present arrangement. The very precise control of the counterweight movements thus further minimizes any tendency for unwanted vibration of the tool, and in addition prevents wear of the counterweight and other parts which might occur if other lateral or swinging forces were exerted against the counterweight.

Figure 12:
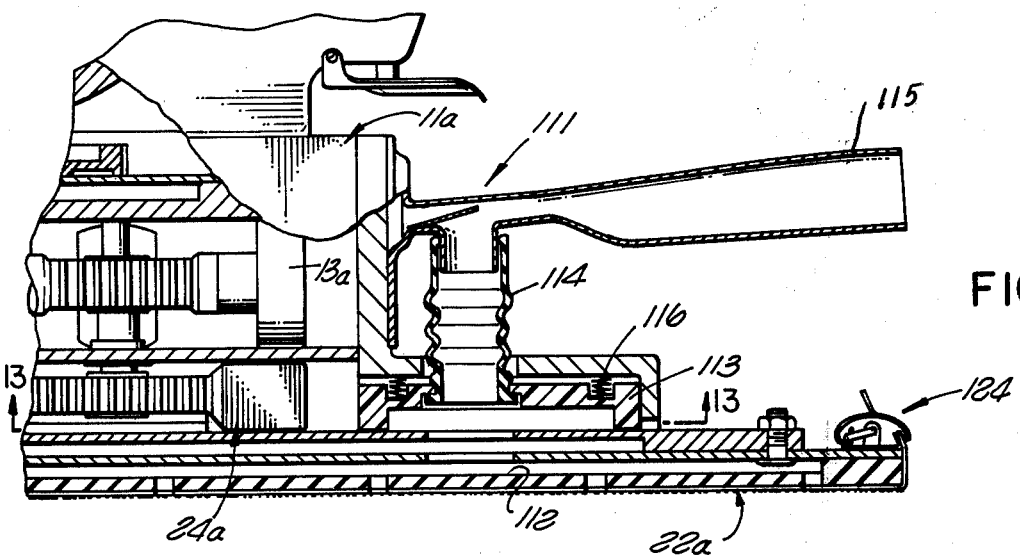
FIG. 12 is a fragmentary vertical section through a variational form of the invention.
Figure 13:
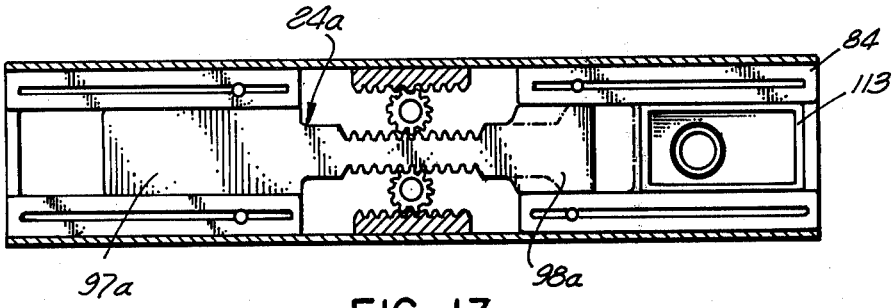
FIG. 13 is a reduced scale view taken essentially on line 13—13 of FIG. 12, and similar to FIG. 2 but showing the variational arrangement of FIG. 12.

In FIGS. 1–11, the two enlargements 97 and 98 of the counterweight are assumed to be of similar size. FIGS. 12 and 13 show a variational arrangement in which the forward enlargement **97*a* of counterweight 24*a*** is heavier and longer in a front to rear direction than the rear enlargement 98*a*, to allow room for reception at the rear of the tool of a suction system similar to that shown in U.S. Pat. No. 4,052,824. In that arrangement, the air exhausted from the cylinder chambers formed in body 11*a* at the opposite ends of piston 13*a* is discharged through an aspirator 111 which is energized by that flow of discharged air to induce a flow of air through passages 112 in shoe assembly 22*a* and upwardly through a part 113 and flexible tube 114 to an outlet 115 through which dust particles picked up by this flow of air from the vicinity of the shoe are discharged to a collection location. The part 113 is carried at the underside of the rear portion of the body, and leaves less room than in FIGS. 1–11 for reception of the rear enlargement 98*a*. The forward enlargement 97*a* may be made longer in a front to rear direction than is the enlargement 97 of the first form of the invention, so that the total weight of the counterweight in FIGS. 12 and 13 is the same as in the first form of the invention. The balancing effect of the counterweight is essentially the same as in the first form of the invention, yet allows for adaptation of the tool for use a a dust free unit acting to withdraw abraded particles from the vicinity of the tool and to a collection point. As will be understood from FIG. 12, the part 13 is spring urged downwardly by coil springs 116, and has a recess at its underside communicating with the passages within the shoe assembly to receive the flow of air and entrained dust particles from the shoe for conduction upwardly through tube 114 to the aspirator.

While certain specific embodiments of the present invention have been disclosed as typical, the invention is of course not limited to these particular forms, but rather is applicable broadly to all such variations as fall within the scope of the appended claims.

I claim:

1. A portable abrading tool comprising:

a cylinder body adapted to be held and manipulated by a user;

a piston structure mounted in said body for reciprocation relative thereto along a predetermined first axis;

valve means for admitting pressure fluid to said cylinder body in a relation causing reciprocation of the piston structures;

two gear units mounted for rotation relative to said body about spaced second and third axes;

means for oscillating said two gear units rotatively relative to said piston structure, and in response to reciprocation thereof, with the two units turning in different rotary directions about said second and third axes as the piston structure moves in a particular direction along said first axis;

a shoe structure driven by said gear units to reciprocate relative to said body and parallel to said first axis, but oppositely from the piston structure, to abrade a work surface;

a counterweight mounted for reciprocation parallel to said first axis relative to said body and said shoe structure; and two racks carried by said counterweight for reciprocation therewith along said first axis, said two racks both facing essentially transversely of said first axis and facing in two essentially opposite transverse directions respectively and engaging gear teeth on said two gear units respectively in a relation driving the counterweight through both of said gear units and both of said racks to reciprocate relative to said body essentially with said piston structure and oppositely from said shoe structure.

2. A portable abrading tool as recited in claim 1, in which said counterweight has a portion received between said two gear units and having said two racks at its opposite sides facing away from one another and engaging said two gear units respectively.

3. A portable abrading tool as recited in claim 1, in which said counterweight has two enlarged portions near opposite ends thereof and a reduced width portion therebetween carrying said two racks.

4. A portable abrading tool as recited in claim 1, in which said counterweight has two enlarged portions near opposite ends thereof and an intermediate reduced width portion received between said two gear units, said two racks being carried at opposite sides of said reduced width portion of said counterweight and having teeth facing away from one another and engaging the two gear units respectively.

5. A portable abrading tool as recited in claim 1, in which said counterweight is confined vertically between said body and said shoe structure and is retained by both the body and shoe structure for said reciprocating movement of the counterweight relative to the body and shoe structure.

6. A portable abrading tool as recited in claim 1, in which said counterweight is slidably guided for reciprocating movement parallel to said first axis within a recess formed in the underside of said body.

7. A portable abrading tool as recited in claim 1, in which said counterweight is supported on said shoe structure for said relative reciprocating movement parallel to said first axis.

8. A portable abrading tool as recited in claim 1, including two laterally spaced bearing elements interposed vertically between said body and said shoe structure at opposite sides thereof, said counterweight being confined between and slidably engaging said two bearing elements.

9. A portable abrading tool as recited in claim 1, in which said body has a recess at its underside within which said counterweight is slidably mounted for reciprocating movement parallel to said first axis, there being leaf spring means received within said recess laterally between said counterweight and a wall of the recess to assist in locating the counterweight for its reciprocating movement.

10. A portable abrading tool as recited in claim 1, in which said body has a longitudinally extending recess at its underside slidably containing a portion of said counterweight, there being an essentially U-shaped leaf spring contained within said recess and having two arms extending along opposite sides of the counterweight and between the counterweight and opposite sidewalls of said recess to assist in locating the counterweight for its reciprocating movement.

11. A portable abrading tool as recited in claim 1, in which said counterweight has two enlarged portions near opposite ends thereof and an intermediate reduced width portion received between said two gear units, said two racks being carried at opposite sides of said reduced width portion and facing away from one another and engaging said two gear units respectively, said body containing two recesses at its underside forwardly of and rearwardly of said gear units and within which said two enlarged portions of the counterweight are slidably received for reciprocating movement parallel to said first axis.

12. A portable abrading tool as recited in claim 11, in which said shoe structure extends across the undersides of said two recesses and slidably confines said enlarged portions of the counterweight within said recesses for said reciprocating movement thereof.

13. A portable abrading tool as recited in claim 12, including two pairs of bearing elements interposed vertically between said body and said shoe structure at opposite sides of said two recesses and slidably engaging opposite sides of said enlarged portions of the counterweight.

14. A portable abrading tool as recited in claim 13, including two U-shaped leaf spring elements received within said two recesses respectively, and each having two spring arms extending along opposite sides of one of said enlarged portions of the counterweight and between that enlarged portion and opposite side walls of the recess.

15. A portable abrading tool comprising:

a cylinder body adapted to be held and be manipulated by a user and containing a cylinder bore closed at its opposite ends;

a piston mounted in said bore for reciprocation relative thereto along a predetermined first axis, said piston having two piston heads reciprocable within opposite ends of said bore and having a reduced portion extending axially between and interconnecting said piston heads;

valve means for admitting pressure fluid to opposite ends of said bore in a relation causing powered reciprocation of the piston relative to said cylinder body;

two racks carried at opposite sides of said reduced portion of the piston and facing away from one another;

two gear units mounted to said body at opposite sides of said reduced portion of the piston for rotation relative to the body about laterally spaced second and third parallel vertical axes and having gear teeth meshing with said two racks to turn the gear units simultaneously in opposite directions upon axial movement of the piston;

a shoe mounted at the underside of said body for reciprocation relative thereto and parallel to said first axis to abrade a work surface;

third and fourth racks attached to said shoe and facing laterally inwardly toward one another;

said two gear units having teeth at their lower ends engaging and meshing with said third and fourth racks respectively to reciprocate the shoe relative to the body but oppositely from said piston;

a counterweight confined vertically between said body and said shoe for reciprocating movement parallel to said first axis;

said counterweight having two enlarged portions near opposite ends thereof and an intermediate reduced width portion received between said lower ends of the gear units; and fifth and sixth racks carried by said reduced width portion of said counterweight at opposite sides thereof and facing away from one another and engaging said teeth at the lower ends of the two gear units respectively and driving the counterweight for reciprocation essentially in unison with said piston but oppositely from said shoe.

16. A portable abrading tool as recited in claim 15, in which said body has two recesses forwardly and rearwardly of said gear units and within which said enlarged portions of the counterweight are slidably guided for their reciprocating movement, said shoe extending across the undersides of said recesses and confining said enlarged portions of the counterweight therein.

17. A portable abrading tool comprising:

a cylinder body adapted to be held and be manipulated by a user;

a piston structure mounted in said body for reciprocation relative thereto along a predetermined first axis;

valve means for admitting pressure fluid to said cylinder body in a relation causing reciprocation of the piston structure;

a shoe mounted for reciprocation relative to said body and parallel to said axis to abrade a work surface;

means driven by said piston structure for reciprocating said shoe relative to said body but oppositely from the piston structure;

a counterweight slidably confined vertically between said body and said shoe for reciprocating movement parallel to said axis; and means for reciprocating said counterweight essentially in unison with said piston structure and oppositely from said shoe.

18. A portable abrading tool as recited in claim 17, in which said body contains a recess at its underside in which said counterweight is slidably guided for its reciprocating movement.

19. A portable abrading tool as recited in claim 18, in which said shoe extends across the underside of said recess in the body and retains said counterweight therein.

20. A portable abrading tool as recited in claim 17, in which said counterweight has two enlarged portions near opposite ends thereof and an intermediate reduced width portion, said body having two axially spaced recesses at its underside within which said two enlarged portions of the counterweight are slidably received.

21. A portable abrading tool as recited in claim 20, in which said shoe extends across the underside of both of said recesses and slidably retains said enlarged portions of the counterweight therein.

* * * * *